United States Patent [19]

Yang

[11] Patent Number: 4,554,809

[45] Date of Patent: Nov. 26, 1985

[54] COMBINATION LOCKING DEVICE FOR SUITCASES

[76] Inventor: Yaw Kuen Yang, 190-30 Chang Shiu Rd., Chang-Hua City, Taiwan

[21] Appl. No.: 540,507

[22] Filed: Oct. 11, 1983

[51] Int. Cl.[4] ..... E05B 37/02

[52] U.S. Cl. ..... 70/312; 70/316

[58] Field of Search ..... 70/312, 315, 316, 317, 70/318

[56] References Cited

U.S. PATENT DOCUMENTS

| | | | |
|---|---|---|---|
| 3,416,338 | 12/1968 | Gehrie | 70/312 |
| 3,555,860 | 1/1971 | Atkinson | 70/312 |
| 4,327,566 | 5/1982 | Ling | 70/312 |
| 4,348,878 | 9/1982 | Chang | 70/5 |

*Primary Examiner*—Robert L. Wolfe

[57] ABSTRACT

An improved combination locking device for suitcases or the like comprises: an open housing body having a pair of protrusions separately formed in the opposing longitudinal sides, and a latching opening in the vertical side; a check plate with a plurality of longitudinally spaced openings formed therein provided in the housing body; a code latch device having a plurality of actuating sleeves and dialing wheels rotatably coupled together installed in the housing body in connection with the check plate; and a manual operating mechanism combined by a coupling frame, a sliding member and a push block installed over the code latch device through a front plate in conjunction with the locations of the actuating sleeves and the dialing wheels; thereby, in addition to performing locking and unlocking functions, the code setting in the latch device can be conveniently changed at any time without opening the suitcase or taking any mechanical operation.

12 Claims, 7 Drawing Figures

COMBINATION LOCKING DEVICE FOR SUITCASES

BACKGROUND OF THE INVENTION

This invention relates to a combination lock device, particularly to that class provided with an operating mechanism by which, in addition to performing locking and unlocking operation, code setting in the latch device can be conveniently changed at any time without opening the suitcase or requiring any mechanical operation.

Conventionally, all combination locks for suitcases are usually constructed with either fixed code settings or adjustable code settings. In the former, the code is easily disclosed, and the combination lock is out of safekeeping function; while, in the latter, the change of the code settings has to be made either by opening the suitcase for effecting the change inside or by pressing the the push member and holding it with one hand for making the adjustment with another hand. This kind of code changing operations is not only inconvenient but also ineffective as a result of the push member often getting stuck therein before being returned to its normal operational position.

SUMMARY OF THE INVENTION

It is accordingly a primary object of this invention to provide an improved combination locking device for suitcases to overcome the foregoing defects associated with the prior art.

According to the present invention, this and other objects are achieved by providing an improved combination locking device for suitcases or the like, which device comprises: an open housing body having a latching opening formed therein; a check plate with a plurality of longitudinal spaced openings provided in the housing body; a code latch device having a plurality of actuating sleeves and dialing wheels rotatably coupled together installed in the housing body in connection with the check plate; and a manual operating mechanism combined by a coupling frame, a sliding member and a push block installed over the code latch device through a front plate in conjunction with the locations of the actuating sleeves and the dialing wheels; thereby, in addition to locking and unlocking functions, the code setting in the latch device can be conveniently changed at any time without opening the suitcase or requiring any mechanical operation.

These characteristics and other advantages of the present invention will become apparent from the following description of a preferred embodiment when read in conjunction with the accompanying drawings.

DETAILED DESCRIPTION OF THE PREFERRED EMBODIMENT

Figure 1:
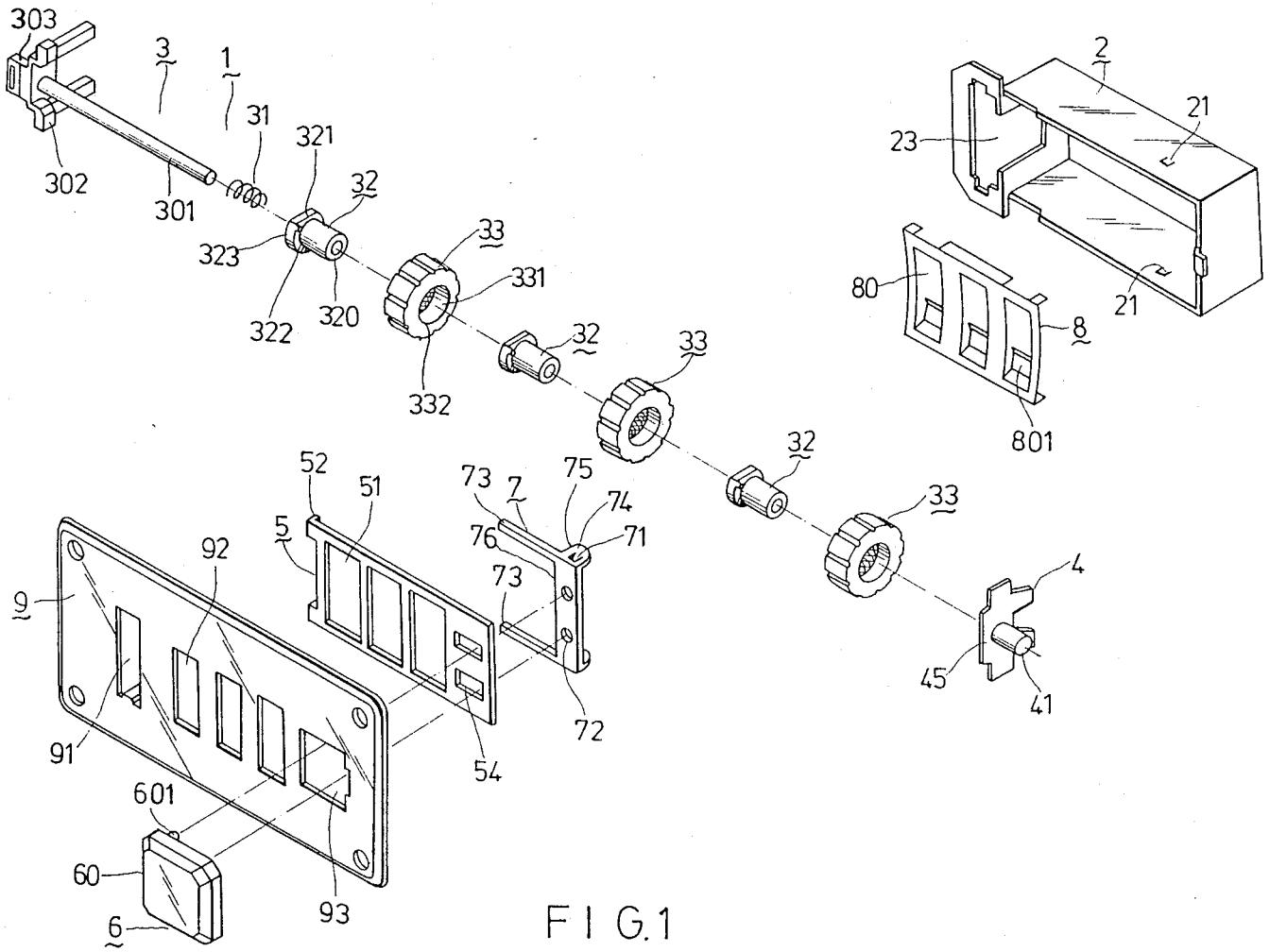
FIG. 1 is a perspective and exploded view of a preferred embodiment of an improved combination locking device according to this invention.
Figure 2:
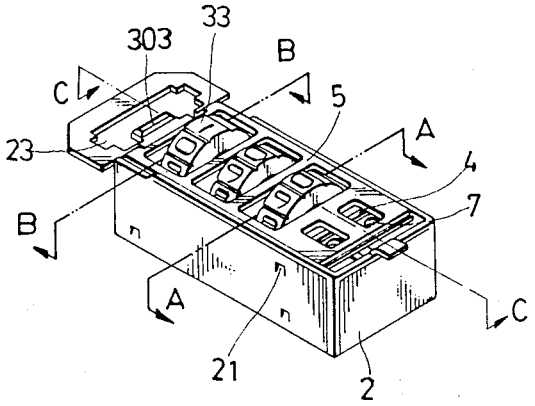
FIG. 2 is a perspective view of the combination locking device assembled from the elements shown in FIG. 1, with certain parts removed.
Figure 3:
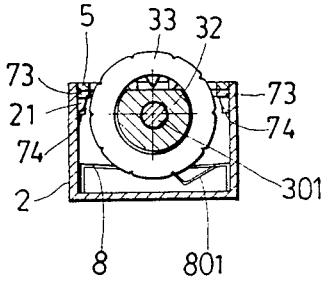
FIG. 3 is a view in section of the combination locking device taken along the line A—A of FIG. 2.
Figure 4:
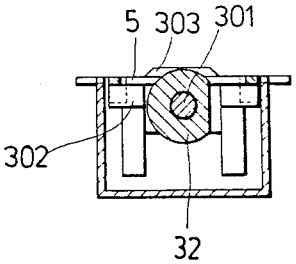
FIG. 4 is a view in section of the combination locking device taken along the line B—B of FIG. 2.
Figure 5:
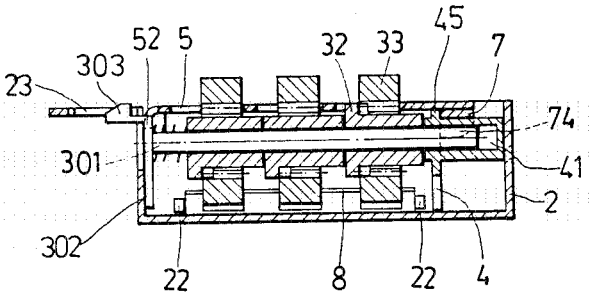
FIG. 5 is a view in section of the locking device taken along the line C—C of FIG. 2, illustrating the locking device in the locked position.
Figure 6:
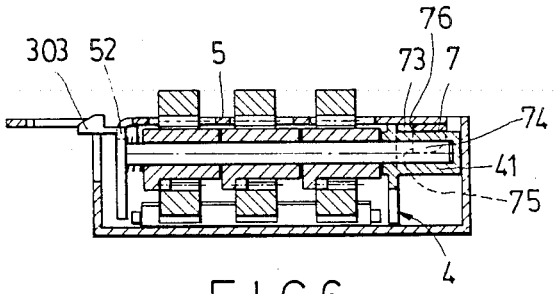
FIG. 6 is a cross-sectional view illustrating the locking device in the unlocked position, with the sliding member 5 pushed to the right.
Figure 7:
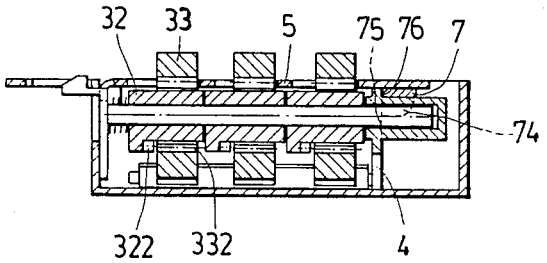
FIG. 7 is a cross-sectional view illustrating the locking device when in the code setting position.

Referring to drawings, there is shown a preferred embodiment of an improved combination locking device for suitcases or the like according to this invention, which device comprises: an open housing body 2 having a pair of protrusions 21 separately formed in the opposing longidudinal sides, and a latching opening 23 in the vertical side; a check plate 8 having a plurality of longitudinal spaced openings 80 each of which has a check piece 801 integrally formed at the back end thereof provided in the housing body 2; a code latch device 1 combined by a latch frame 3 having a spindle 301 horizontally fixed on a frame head 302 with a latch tongue 303 integrally formed thereto, a spring 31 engaged around the spindle 301, a plurality of actuating sleeves 32 each having a hollow shank portion with a central bore 320 of a diameter sightly greater than the diameter of the spindle 301, a dent portion 321 at one side of the head edge, a protrusion 323 at the opposing sides thereof, and a toothed portion 322 at the opposite side of the dent portion 321, separately engaged around the spindle 301 through the center bore 320; a plurality of dialing wheels 33 each having a central opening 331 of a diameter larger than that of the shank portion but smaller than the head of the actuating sleeves 32 with a toothed portion 332 formed therein corresponding to the toothed portion 322 of the actuating sleeves 32, and each provided with numerals in equally spaced relation on the outer circumference, respectively and rotatably engaged around the shank portions of the actuating sleeves 32 by meshing the toothed portions 332 respectively with the toothed portions 322 of the actuating sleeves 32; and a coupling head 4 having a wall 45 and a hollow stub 41 with the bore greater than the diameter of the latch spindle 301 connected to the free end of the latch spindle 301 with a clearance at least in 2 mm left in the end of the hollow stub 41 for allowing the movement of the spindle 301 therein. The combined code latch device 1 is installed in the open housing body 2 with the dialing wheels 33 respectively positioned in the longitudinal openings 80 of the check plate 8 for being in contact with the check pieces 801 so as to control the rotation of the dialing wheels 33 only in one direction therein while the outer end of the stub 41 abuts against the inner wall of the housing body 2 and the latch tongue 303 loosely located in the latching opening 23 thereof. A manual operating mechanism 6 which includes: a latch sliding member 5 having a plurality of longitudinally spaced larger openings 51, a pair of horizontally spaced smaller openings 54, and a pair of bend tabs 52 integrally formed thereto; a coupling frame 7 having edges 75 and 76, a pair of indentations 71 respectively formed in a tab surface or securing ear 74 at one side thereof, a pair of rivet holes 72 in the vertical side for being movably aligned with the smaller openings 54 of the sliding member 5 and a pair of forked portions 73; a push block 60 having a pair of rivet pins 601 connected to the coupling frame 7 through opening 93 of a front plate 9, and openings 54 of latch sliding member 5. The front plate 9 has a latch opening 91 and a plurality of longitudinally spaced slots 92 respectively corresponding to the latching opening 23 of the housing body 2 and the openings 51 of the sliding member 5. The push block 60 has rivet pins 601 which connect to rivet holes 72 in the coupling frame. The coupling frame 7 is located on the hollow stub 41 of the coupling head 4 with edges 75, 77 thereof abutting against the wall 45, as shown in FIGS. 5 and 6. The forked portions 73 and securing ears 74 abut against the longitudinal sides of the housing body 2, as shown in FIG. 3.

It shall be appreciated that, after the manual operating mechanism 6 is coupled with the code latch device 1, the protrusions 323 of the actuating sleeves 32, together with the outer edges of the dialing wheels 33, are respectively positioned within the longitudinal openings 51 of the latch sliding member 5, but only the outer circumferential surfaces of the dialing wheels 33 are separately received in the longitudinal slots 92 of the front plate 9, and that the bend tabs 52 of the sliding member 5 are fitfully engaged with the frame head 302 of the latch frame 3.

Operations of locking, unlocking and code setting change of the preferred embodiment are as follows:

When any one of the dent portions 321 of the actuating sleeves 32 is not turned to completely face the push block 60, the preferred embodiment is in locked position because the protrusion 323 of the actuating sleeve 32 (any one) is kept in the longitudinal opening 51 of the sliding member 5, which is connected to the latch frame 3, and prevent it from being moved to the left together with the push block 60. Once all the dent portions 321 of the actuating sleeves 32 are turned to completely face the push block 60 along with the turning action of the dialing wheels 33 according to the preset code settings, the preferred embodiment is in unlocked position because, in this condition, all the protrusions 323 of the actuating sleeves 32 are away from the longitudinal openings 51 of the sliding member 5 except for the dialing wheels 33, which always remain therein, and the clearance left between each dialing wheel 33 and the left side of the opening 51 is sufficient to enable the sliding mamber 5 to be moved to the right. Therefore, by pushing the push block 60 to the right, the sliding member 5 will move the latch frame 3 backward to disengage the latch tongue 303 with the hasp (not shown) and effect the unlocking operation. In this condition, the spring 31 is compressed thereat, and the free end of the latch spindle 301 is moved into the left clearance of the hollow stub 41. By releasing the push block 60, the sliding member 5, together with the latch frame 3, will automatically return to the original position through the expansion force of the spring 31. If the user wishes to re-set the code settings for ensuring its safety function, just turn the dialing wheels 33 to the preset code positions (if the preferred embodiment is in locked condition), and push the push block 60 to the left. In this condition, edges 75, 76 of the coupling frame 7 will press the wall 45 of the coupling head 4 which in turn acts on the immediately adjacent sleeve 32. In this way, each protrusion 323 of the actuating sleeve 32 will also be pressed forward one after another and disengage the toothed portions 322 with the toothed portions 332 of the dialing wheels 33, which are therefore made in race rotation around the shank portions of the actuating sleeves 32. Meanwhile, the indentations 71 in the coupling frame 7 will also be respectively engaged with the protrusions 21 of the housing body 2 so as to hold the operating mechanism 6 in the left position. Therefore, the user can conveniently re-set the code settings as he desires by separately turning the dialing wheels 33 to whatever numeral codes he likes, and then push the push block 60 back to the normal position. In this condition, the edges of the openings 51 will respectively press the actuating sleeves 32 into engagement with the dialing wheels 33 through the toothed portions thereof. When the hasp is positioned in the latch opening 91, turning the dialing wheels 33 at random, the suitcase is safely locked therewith.

While a specific embodiment of this invention has been illustrated and described, it is to be understood that numerous changes and modifications may be made there without departing from the spirit and scope of this invention as defined in the appending claims.

What is claimed is:

1. A combination locking device comprising:

a housing body;

code latch means mounted within the housing body, the code latch means comprising: a frame head movable between a locked and an unlocked position; a spindle connected to and extending from the frame head; sleeves rotatively mounted on the spindle, each sleeve having a shank, an annular protrusion on the shank with a dent portion thereon, and a toothed portion; a wheel axially mounted about the shank of each sleeve, each wheel having a toothed portion engageable with the toothed portion of the sleeve and numbers thereon for code setting; a coupling head having a hollow stub for slidably receiving therein the free end of the spindle; and biasing means normally urging the sleeves and wheels into toothed engagement and the frame head into the locked position; and manual operating means comprising: a latch sliding member connectable to the frame head and adapted to move the frame head against the action of the biasing means into the unlocked position; coupling means for disengaging the toothed portions of each sleeve and its corresponding wheel respectively so that the wheels can freely rotate about the shank of the sleeve to permit changing of the code setting; and push block means connected to both the latch sliding member and the coupling means so that each can be independently operated by the push block means.

2. A locking device as claimed in claim 1 further comprising a front plate interjacent the push block on the one hand and the latch sliding member and coupling means on the other hand, the front plate having openings therein corresponding to the wheels and through which an arcuate portion of a wheel projects to prevent such wheel from lateral movement.

3. A locking device as claimed in claim 1 wherein the coupling means comprises a coupling frame connected to the push block and the coupling head, the coupling frame acting on the coupling head to move each sleeve along the axial length of the spindle away from its corresponding wheel thereby disengaging the toothed portions of the sleeves and wheels respectively.

4. A locking device as claimed in claim 1 further comprising a check plate mounted in the housing, the check plate including a check piece associated with each wheel to permit rotation of the wheel in one direction only.

5. A locking device as claimed in claim 1 wherein the biasing means comprises a spring mounted on the spindle.

6. A locking device as claimed in claim 1 wherein the latch sliding member includes a pair of bent over tabs which are adapted to engage the frame head.

7. A locking device as claimed in claim 2 wherein the housing body includes one or more protrusions, and the coupling frame has corresponding indentations, the protrusions and indentations engaging one another when the coupling frame is moved to disengage the toothed portions of the wheels and the sleeves respectively, to facilitate code setting of the wheels.

8. A locking device as claimed in claim 2 wherein the coupling frame and coupling head, when moved in the direction of the frame head, cause the toothed portions of the sleeve to disengage from the toothed portions of the dialing wheels.

9. A combination locking device comprising:

a housing body having a protrusion in the walls thereof;

code latch means mounted within the housing body, the code latch means comprising: a frame head having a latch tongue movable between a locked and an unlocked position; a spindle connected to and extending from the frame head; sleeves rotatively mounted on the spindle, each sleeve having a shank, an annular protrusion on the shank with a dent portion thereon, and a toothed portion; a wheel axially mounted about the shank of each sleeve, each wheel having a toothed portion engagable with the toothed portion of the sleeve and numbers thereon for code setting; a coupling head having a hollow stub for slidably receiving therein the free end of the spindle; and biasing means normally urging the sleeves and wheels into toothed engagement and the frame head into the locked position;

manual operating means comprising: a latch sliding member including a pair of bent over tabs for engagment with the frame head, the latch sliding member being adapted to move the frame head against the action of the biasing means into the unlocked position; a coupling frame connected to the coupling head, the coupling frame acting on the coupling head to move each sleeve along the axial length of the spindle away from its corresponding wheel thereby disengaging the toothed portions of the sleeves and wheels respectively so that the wheels can freely rotate about the shank of the sleeve to permit changing of the code setting, the coupling frame further having indentations which corresponding to the protrusions on the housing body, the protrusions and indentations engaging one another when the coupling frame is moved to disengage the toothed portions of the wheels and the sleeves respectively to facilitate code setting of the wheels; push block means connected to both the latch sliding member and the coupling frame so that both the latch sliding member and coupling frame can be independently operated by the push block means; and a front plate interjacent the push block on the one hand and the latch sliding member and coupling frame on the other hand, the front plate having openings therein corresponding to the wheels and through which an arcuate portion of a wheel projects to prevent such wheel from lateral movement; and a check plate mounted in the housing, the check plate including a check piece associated with each wheel to permit rotation of the wheel in one direction only.

10. A locking device according to claim 4 wherein the periphery of said dialing wheels is respectively located in a corresponding opening of said check plate with the outer surface of each said dialing wheel in contact with the check piece so as to effect a unilateral turning therewith.

11. A locking device according to claim 3 wherein said push block is riveted to said coupling frame.

12. A locking device according to claim 1 wherein said latch sliding member is characterized in that when said push block is moved in a direction away from the frame head, said latch sliding member, through the frame head, moves the actuating sleeves to engage with the toothed portions of said dialing wheels.

* * * * *